United States Patent [19]

Zuvela et al.

[11] 4,143,721

[45] Mar. 13, 1979

[54] CHANGE IN LENGTH OF DRILL STRING CONTAINING AN INSTRUMENT

[75] Inventors: Bernard R. Zuvela; Raymond W. Teys, both of Fountain Valley, Calif.

[73] Assignee: Scientific Drilling Controls, Newport Beach, Calif.

[21] Appl. No.: 838,804

[22] Filed: Oct. 3, 1977

[51] Int. Cl.[2] ..... E21B 47/02

[52] U.S. Cl. ..... 175/45; 175/61; 175/62; 175/85; 175/320

[58] Field of Search ..... 175/40, 45, 50, 85, 175/61, 57, 62, 320, 45; 324/10; 174/47; 339/16 R, 16 CR; 254/134 R, 134 CL, 134 PA, 134.7

[56] References Cited

U.S. PATENT DOCUMENTS

| | | | |
|---|---|---|---|
| 2,370,818 | 3/1945 | Silverman | 175/40 |
| 3,285,629 | 11/1966 | Cullen et al. | 175/104 X |
| 3,825,078 | 7/1974 | Heilhecker et al. | 175/57 |

FOREIGN PATENT DOCUMENTS

| | | | |
|---|---|---|---|
| 166011 | 2/1934 | Switzerland | 175/19 |

*Primary Examiner*—Ernest R. Purser
*Assistant Examiner*—Richard E. Favreau
*Attorney, Agent, or Firm*—William P. Green

[57] ABSTRACT

Methods and apparatus are provided for enabling an instrument and a connected flexible line contained in a drill string to be left in the string while a pipe section is being added to or removed from the string, to thereby avoid the inconvenience and loss of time normally involved in removing the instrument and flexible line from the string on each such occasion. This result is preferably accomplished by initially threading the flexible line at the surface of the earth through a series of extra pipe sections positioned at a storage location adjacent the well, so that each of these sections can then be successively moved from that location to a position of connection into the upper end of the drill string with the flexible line already installed in the added section.

16 Claims, 6 Drawing Figures

CHANGE IN LENGTH OF DRILL STRING CONTAINING AN INSTRUMENT

BACKGROUND OF THE INVENTION

This invention relates to improved methods and apparatus for drilling wells or other holes in the earth by equipment in which an instrument is carried within the drill string during a drilling operation.

In drilling holes into the earth, it is frequently desirable to monitor one or more conditions in the hole repeatedly during the drilling operation, in order to assist in making decisions as to what steps, if any, should be taken in controlling or altering the drilling procedure. For example, it is often helpful to position in the drill string near the bit an inclinometer probe, which can sense the inclination of the drill string in the earth, and sense the azimuth of that inclination, and transmit the information to a read-out unit at the surface of the earth. Equipment of this general type is disclosed in U.S. Pat. Nos. 3,791,043 and 3,862,499. One inconvenience which has been encountered in the use of such equipment has resided in the loss of time and effort involved in removing the instrument and its flexible suspending line from the drill string each time that another section of pipe is added to the string. Since the flexible line extends out of the drill string at the surface of the earth, it has been thought impossible to connect another pipe section to that end of the string so long as the flexible line is in place. Consequently, the flexible line is normally wound on a drum at the surface of the earth to pull the line and connected instrument from the well, following which the next successive pipe section can be connected to the string and the instrument and flexible line can then be lowered through the added section and into the drill string to the drilling depth.

SUMMARY OF THE INVENTION

The general purpose of the present invention is to provide methods and apparatus for drilling with equipment which utilizes an instrument probe and flexible line in the string as discussed, but to do so in a manner avoiding the usual necessity for withdrawing the instrument and line each time the length of the drill string is changed.

In the preferred arrangement disclosed in the present application, this result may be achieved without interrupting or in any way affecting the electrical connection between the probe in the string and the read-out or other connected unit at the surface of the earth. Desirably, this is accomplished by, at the outset of the drilling operations, threading the flexible line, after it leaves the outer or upper end of the drill string, through a series of additional pipe sections which are positioned at a storage location near the well, and which are eventually to be added in sequence to the upper end of the string. The line is threaded through these various extra pipe sections successively, and is then led to the read-out or other unit at the surface of the earth. When thus threaded through the extra pipe sections at the storage location, it is possible to move each of the sections from the storage location to the outer end of the drill string for connection thereto without altering the manner in which the flexible line is pre-threaded through that section. As many sections as may be desired can in this way be moved in either direction while the electrical connection between the instrument and the surface carried unit through the flexible line remains unaffected. The flexible line may extend from the outer end of the drill string through a pressure head, which acts to introduce circulating fluid into the string, and which may be detached from the outer section of the string when the length of the string is being changed.

BRIEF DESCRIPTION OF THE DRAWINGS

The above and other features and objects of the invention will be better understood from the following detailed description of the typical embodiment illustrated in the accompanying drawings in which.

DESCRIPTION OF THE PREFERRED EMBODIMENT

Figure 1:
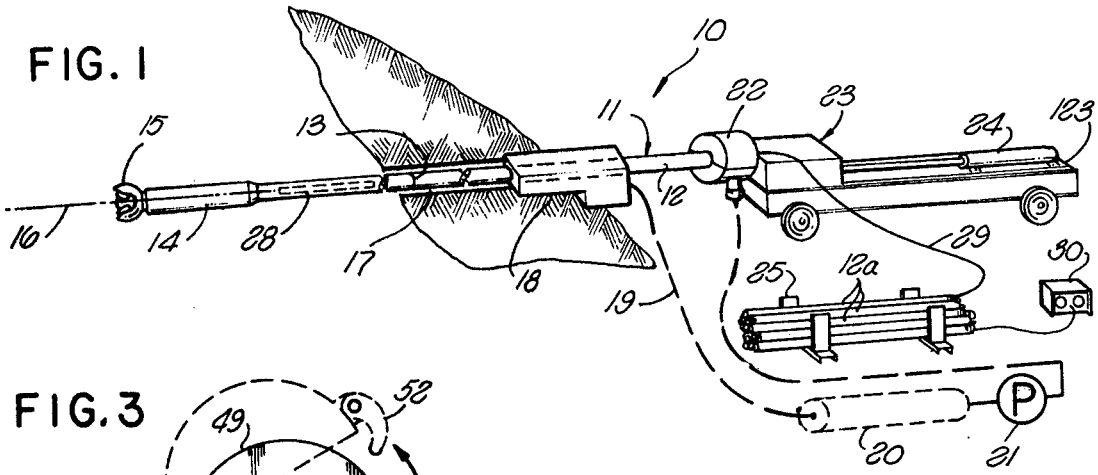
FIG. 1 is a diagrammatic representation of drilling equipment embodying the present invention, and typically illustrated as drilling a generally horizontal hole into the earth.

The present invention can be applied to the drilling of a hole or well into the earth in any direction, that is, either vertically, horizontally, or at any inclination. The drawings typically illustrate use of the invention in apparatus for drilling generally horizontally into the earth, as for instance in the mining of coal. With particular reference to FIG. 1, the equipment shown includes a tubular drill string 11 formed of a series of drill pipe sections 12 threadedly interconnected in end to end relation at joints 13. At its lower end, the string 11 carries a drill 14 which may be of a conventional type containing a motor driven by the pressure of circulating fluid pumped downwardly through the drill string 11 and acting to drive a bit 15 rotatively about the main axis 16 of the device to drill the hole 17 into the earth formation. When a drill of this type is employed, the string 11 does not itself rotate during the drilling operation. However, it is to be understood that the invention can, if desired, be applied to apparatus in which the drill string 11 is itself power rotated from its outer end to drive a bit rigidly connected to its inner end.

The drill string 11 extends through a stuffing box 18 which closes off the annular space about the drill string at the surface of the earth, and which may receive the circulating fluid from that space and deliver it through a line diagrammatically represented at 19 to a collection chamber or sump 20 from which it is delivered by a pump 21 to a pressure head 22 connected to the outer end of the drill string 11 at the surface of the earth. This circulating fluid is thus injected into the outer end of the drill string through the pressure head 22 for delivery to motor 14, and for emission at the bit location to carry cuttings back to the surface through the annular space about the drill string.

Axial force may be applied to the drill string in a leftward direction as viewed in FIG. 1 by any of the known types of units conventionally employed for this purpose. In FIG. 1, there is represented somewhat diagrammatically at 23 a unit which is mounted movably to a wheeled carriage 123, and which is moved relative to the carriage by a power cylinder or other power unit 24, while the carriage is fixed against movement, to apply leftward or axially inward force against the pressure head 22 and connected drill string and bit as the latter turns.

A rack 25 located on the surface of the earth near the outer end of the drill string 11 contains a series of pipe sections 12*a* which are to be added successively to the outer end of string 11 as the drilling progresses, to thereby lengthen the drill string as necessary until an appropriate depth in the earth is reached by bit 15. These sections 12*a* are identical with the sections 12 which are shown already assembled into the string in FIG. 1, and like those sections 12 are threaded at their opposite ends for attachment to the string. The sections 12*a* are aligned in rack 25 in parallel stacked relation, with alternate sections reversed longitudinally relative to one another, so that at each level in the stack the externally threaded end 26 of each section 12*a* is adjacent the internally threaded end 27 of a next successive section, et cetera.

Figure 2:
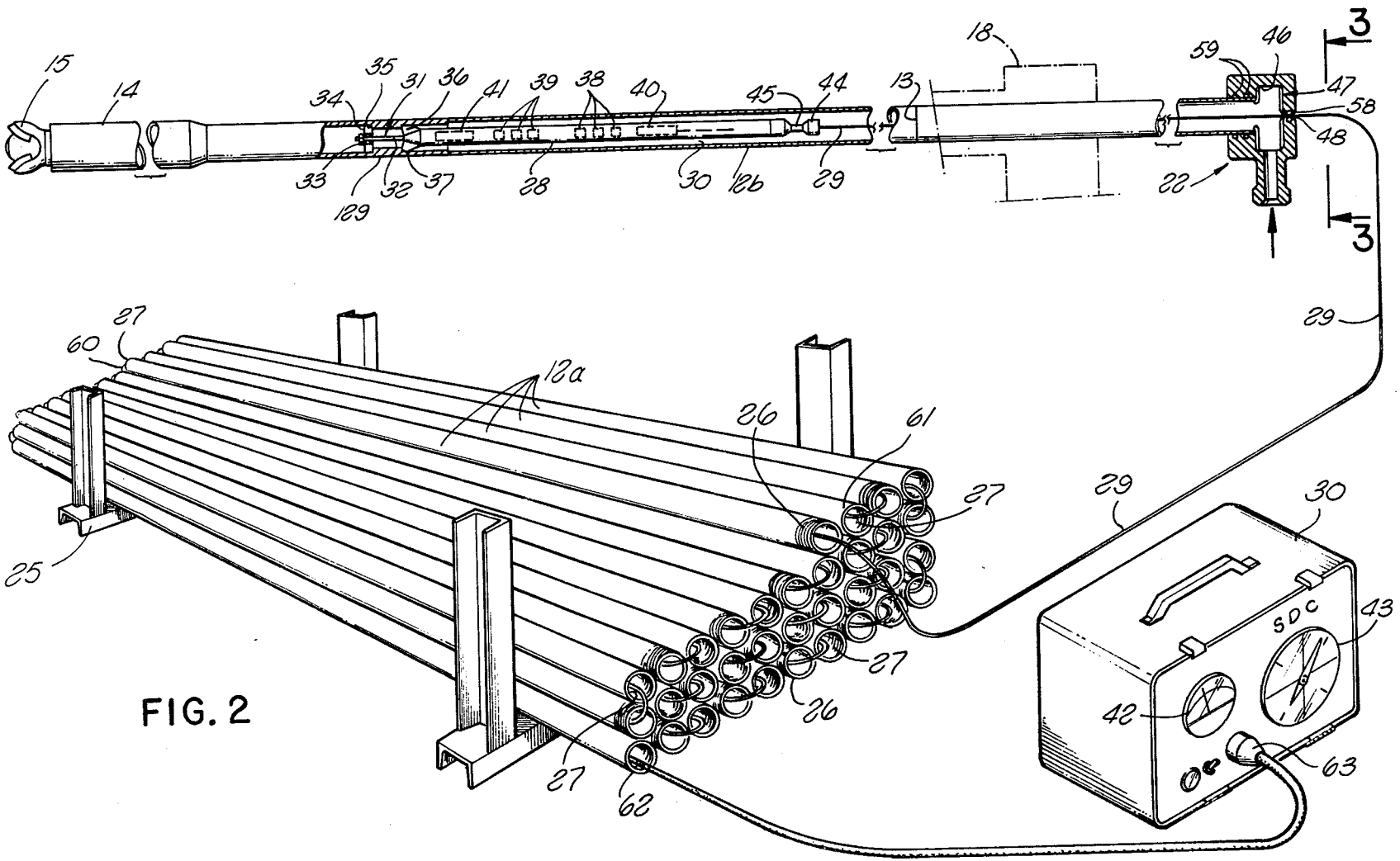
FIG. 2 is an enlarged diagrammatic representation of the equipment of FIG. 1.

Contained within the drill string near its inner end, and adjacent the drill 14, there is provided an instrument 28 (FIGS. 1 and 2), which may be an inclinometer probe of the type disclosed in U.S. Pat. No. 3,791,043 or U.S. Pat. No. 3,862,499, electrically connected by a flexible line 29 to a read-out unit 30 at the surface of the earth as in those patents. Probe 28 is mounted in a non-magnetic section 12*b* of the drill string, and may have its lower end anchored within an attaching sub 129 connected into the string between section 12*b* and the drill. Probe 28 is located centrally within section 12*b*, and extends along the main axis 16 of the drill string, with a space 30 being provided about the probe 28 for passing pressure fluid therepast. A connection 31 secures the inner end of probe 28 to sub 129, as by provision of an externally threaded rod 32 rigidly connected to and projecting from the body of the probe and connectable to a nut 33 bearing against the central portion of a fluid passing spider 34 which is tightened against a shoulder 35 in sub 129. A plurality of circularly spaced radially projecting fins 36 attached to the probe 28 may bear in the opposite direction against an annular shoulder 37 formed in the sub, so that by tightening of nut 33 on rod 32 the entire probe is secured in fixed centered position within the drill string.

Probe 28 contains sensing elements 38 responsive to different components of the earth's magnetic field, to sense directional orientation of the probe relative to that earth's field, and also contains gravity responsive elements 39 which sense inclination of different reference axes fixed relative to the probe with respect to the vertical. Electronic circuitry 40 energized by a battery 41 responds to elements 38 and 39 to produce signals which are fed to the surface of the earth through conductor 29, in multiplex form, and to which read-out unit 30 responds to indicate at 42 and 43 the inclination of the probe with respect to the vertical, the azimuth of that inclination and/or any other desired read-out information. Line 29 desirably is a single conductive wire of copper or the like, insulated by nylon or other insulating material capable of withstanding substantial wear without damage thereto. The inner end of line 29 is mechanically connected to an element 44 which is attached by a frangible connector 45 to the outer end of probe 28, so that when desired the connection at 45 can be broken by exertion of pulling force on line 29 from the surface of the earth. For this purpose the connection 45 of course has substantially less strength than does line 29 or the element 44, or probe 28 or its attachment at 31 to the drill string. The conductor within line 29 is electrically connected through elements 44 and 45 to the solid state electronic equipment 40 within probe 28, to receive multiplexed signals from unit 40 interpretable by unit 30 at the surface of the earth to produce the desired read-outs.

Figure 3:
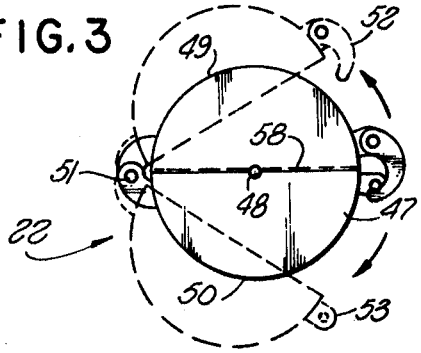
FIG. 3 is an end view of the pressure head of FIG. 2, taken on line 3—3 of that figure.

The pressure head 22 contains an inner chamber 46 (FIG. 2) through which the pressurized liquid flows into the outer end of the drill string. This chamber 46 is desirably closed at its outer end by a transverse wall 47, which preferably contains a central opening 48 through which the flexible line 29 extends in sealed relation. To enable removal of pressure head 22 from the outer end of the drill string, head 22 may be formed of two complementary essentially semicircular halves 49 and 50 (FIG. 3), pivoted together at 51 for relative opening movement from the full line closed position of FIG. 3 to the broken line positions of that figure. At a location diametrically opposite hinge connection 51, the sections 49 and 50 of the pressure head may have latch parts 52 and 53 adapted to interfit in a manner positively but releasably locking the sections 49 and 50 in their closed position. In that condition, seal elements including those represented at 58 and 59 form fluid tight seals between these parts and about the flexible line 29 and drill string 11 in a relation positively preventing leakage of any pressure fluid at the location of the pressure head 22 or past line 29.

To now describe a cycle of use of the equipment, assume first of all that the drill 14 and sub 129 as well as the connected non-magnetic pipe section 12*b* and the contained probe 28 have been advanced into the earth, with at least one additional pipe section 12 connected in the string, and with the flexible line 29 extending outwardly through the string and through pressure head 22. With the apparatus in this condition, the flexible line 29 is threaded through the various additional pipe sections 12*a* in rack 25 in the manner illustrated in FIG. 2. More particularly, it is noted that this flexible line extends first into the externally threaded end 26 of one of the pipe sections, then extends out of the opposite internally threaded end 27 of that section, then crosses over at 60 in FIG. 2 to enter the adjacent externally threaded end of a next successive adjacent section 12*a*, ultimately coming out of the internally threaded end 27 of that section at 61 and crossing over to enter the externally threaded end of the next successive pipe section, et cetera, so that in effect the flexible line is threaded through the various sections 12*a* sequentially, first entering the end of each of those sections through its externally threaded end. As will be understood, and as is conventional, the externally threaded end of each pipe section is the inner end when that section is connected into the drill string. After the line 29 has been threaded in this manner through all of the sections on the rack 25, line 29 ultimately leaves the internally threaded end of the last section in the bottom row of the rack at 62, from which it extends to a point of connection at 63 to unit 30.

Figure 4:
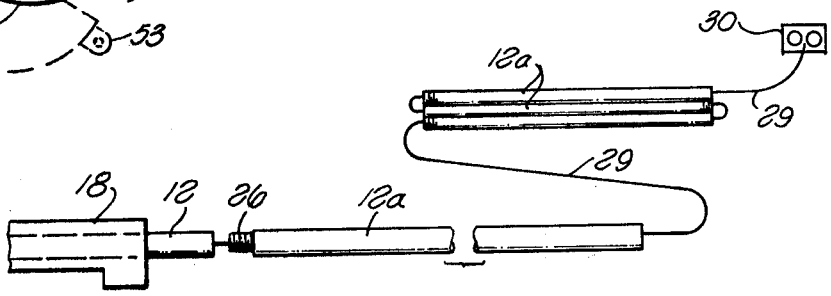
FIG. 4 is a view similar to FIG. 1, but showing the pressure head removed and a section of drill pipe being added to the drill string.
Figure 5:
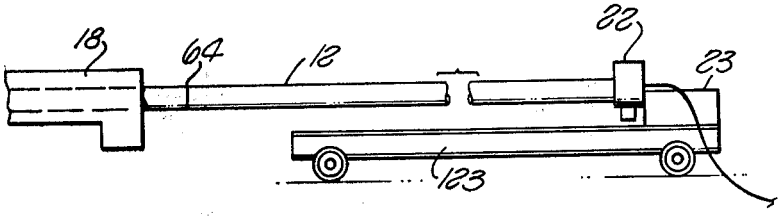
FIG. 5 represents the next step showing the pressure head attached to the outer end of the added pipe section; and, FIG. 6 shows the manner in which the flexible line may ultimately be detached from the instrument in the drill string, and withdrawn separately from the string.
Figure 6:
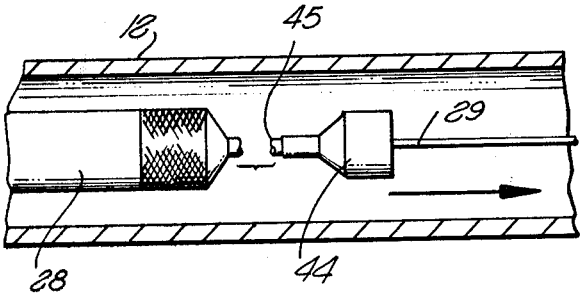

During drilling, the bit 15 is rotated by the motor in drill 14, driven by pressure fluid flowing through pressure head 22 as discussed, with the unit 23 gradually forcing the entire drill string leftwardly in FIG. 1 as the bit advances in the earth. When the end section 12 of the drill string reaches a point at which it is necessary to add another section, the operator stops the drilling operation, releases the force exerted by unit 23, stops the flow of fluid through the system, and releases latch elements 52 and 53 to open pressure head 22 and permit it to be removed from the end of the string. The first of the sections 12*a* in rack 25 is then lifted from the rack and moved to a position of alignment with the end of the drill string, as seen in FIG. 4, and is then advanced leftwardly in FIG. 4 and rotated to form a threaded connection with the end section 12, as represented at 64 in FIG. 5. The pressure head 22 is then reattached to the drill string, this time being connected to the outer or right end of the added section 12*a*, so that pump 21 may be started to resume the operation of the drill and the flow of liquid through the apparatus, and unit 23 may be re-energized to exert leftward force against the drill string for further advancement of the drill into the earth. Each time that a section must be added to the drill string, the next successive extra drill pipe section 12*a* is moved from rack 25 and connected to the string as discussed, but without in any instance breaking the electrical connection through line 29 from probe 28 to read-out unit 30. Consequently, inclination and azimuth read-outs can be obtained whenever desired, and there is no necessity for the usual very inconvenient and time consuming process of withdrawing the probe from the string whenever a section is to be added to the string.

After the full drilling depth has been attained, and all of the desired readings with the probe 28 have been made, a user can detach pressure head 22 and then exert an outward pulling force (rightwardly in the figures) against line 29 to break the frangible connection at 45 and permit the flexible line 29 to be pulled completely out of the drill string, but leaving the probe in the drill string. The various sections of the drill string may then be easily disconnected sequentially from the string, so that the entire string can be rapidly taken out of the hole. The string may also be removed in this manner whenever it is desired to replace or repair the bit or the drill motor, and on each such round trip the probe may be serviced and its battery replaced if necessary.

While the major advantage of the invention is attained when sections are being added to the drill string, it is also contemplated that if desired the flexible line can be left in the drill string when sections of the string are being removed. In such instances, each removed section can be placed back in the appropriate position on rack 25 while the line 29 remains threaded through all of the sections including the one just removed, to thereby maintain the electrical connection between the probe and unit 30 without interruption while the string is being shortened, in essentially the same manner as discussed in connection with the section adding process.

While a certain specific embodiment of the present invention has been disclosed as typical, the invention is of course not limited to this particular form, but rather is applicable broadly to all such variations as fall within the scope of the appended claims.

We claim:

1. The method that comprises:

drilling a hole into the earth using a drill string formed of a series of interconnected tubular pipe sections having drilling means at an inner end of the string;

carrying in said drill string an instrument having a flexible conductive line extending from the instrument through the drill string to a unit at the surface of the earth;

changing the length of the drill string by successively moving different pipe sections between a storage location near the hole and a position of connection to the outer end of the string;

threading said flexible line through the drill string and through said pipe sections at said storage location; and leaving said flexible line threaded through said pipe sections as they are moved between said locations.

2. The method as recited in claim 1, including supplying pressurized circulating fluid to said outer end of the drill string through a fitting connected thereto during the drilling operation, and removing said fitting from the outer end of the drill string while the length of the string is being changed by movement of a section between said locations.

3. The method as recited in claim 1, including producing at said unit at the surface of the earth an indication of a condition or conditions sensed by said instrument in the hole.

4. The method as recited in claim 1, including ultimately detaching said flexible line from said instrument and withdrawing the flexible line from the drill string while the instrument remains therein.

5. The method as recited in claim 1, including ultimately detaching said flexible line from the instrument by exertion of upward force on the line and thereby breaking a frangible connection between the line and instrument, and removing the line from the drill string while leaving the instrument therein.

6. The method as recited in claim 1, including ultimately detaching said flexible line from the instrument by exertion of upward force on the line and thereby breaking a frangible connection between the line and instrument, and then removing the drill string from the hole sectionally while the instrument remains in the string.

7. The method that comprises:

drilling a hole in the earth using a drill string formed of a series of interconnected pipe sections having drilling means at an inner end of the string;

positioning in the drill string an instrument for sensing a condition in the hole;

advancing the string into the hole while the instrument is contained therein;

successively moving pipe sections from a storage location near the hole to an outer end of the drill string, and connecting the sections successively to said outer end of the drill string to increase its length during the drilling operation;

threading a flexible conductive line from said instrument through the drill string to said outer end thereof, and then successively through different ones of said pipe sections at said storage location, and then to said unit; and leaving said flexible line threaded through each of said pipe sections as the section is moved from said storage location to the outer end of the drill string for connection thereto.

8. The method as recited in claim 7, including introducing a flow of circulating fluid into the outer end of the drill string through a pressure head attached to said outer end during the drilling operation, detaching said pressure head from the outer end of the drill string when each pipe section is to be added thereto, and connecting the pressure head to an outer end of each added section after the section has been attached to the drill string to thereafter supply pressure fluid to the drill string through said added section.

9. The method as recited in claim 8, in which said flexible line extends through said pressure head in sealed relation, said method including opening the pressure head to a condition releasing it from attachment to the flexible line each time that the pressure head is detached from the outer end of the drill string, and closing the pressure head into sealed engagement with the flexible line when the head is attached to each added section.

10. The method as recited in claim 9, including ultimately detaching said flexible line from said instrument by exertion of pulling force on the flexible line breaking a frangible connection between it and the instrument, withdrawing the flexible line from the outer end of the drill string, and then removing the drill string from the hole sectionally while the instrument remains in the string.

11. Well drilling apparatus comprising:

a drill string extending into a hole in the earth and formed of a series of interconnected pipe sections having drilling means at an inner end thereof;

an instrument carried in the drill string;

a plurality of additional pipe sections positioned at a storage location near the well and adapted to be successively added to an outer end of the drill string to increase its length as the drilling progresses;

a unit at the surface of the earth to be connected electrically to said instrument; and a flexible conductive line extending from said instrument through the drill string to the surface of the earth and then threaded through a plurality of said additional pipe sections at said storage location successively, and then to said unit.

12. Apparatus as recited in claim 11, including a pressure head connected to said drill string at the surface of the earth and through which circulation fluid is introduced into the upper end of the string.

13. Apparatus as recited in claim 12, in which said flexible line extends through said pressure head in sealed relation.

14. Apparatus as recited in claim 11, including a pressure head detachably connectable to the outer end of the drill string, and containing an opening through which said flexible line extends in fluid tight sealed relation, and adapted to be opened to a condition separating the pressure head from the flexible line to enable connection of said additional pipe sections to the drill string.

15. Apparatus as recited in claim 14, in which said instrument is an inclinometer, and said unit is a read-out device indicating the inclination of said instrument and the azimuth of said inclination.

16. The method that comprises:

drilling a hole in the earth utilizing a drill string formed of a number of interconnected pipe sections carrying drilling means at the end of the string, with an instrument contained in the string and a flexible conductive line extending from the instrument through the string to the surface of the earth and connecting to a unit at the surface of the earth;

threadedly connecting an additional pipe section into the drill string at the surface of the earth to increase the length of the string;

leaving said instrument and flexible line in the string while the length of the string is being increased;

ultimately detaching said flexible line from said instrument and withdrawing the flexible line from the drill string; and then removing the drill string from the hole sectionally while the instrument remains in the string.

* * * * *